US009710002B2

(12) United States Patent
Easwaran et al.

(10) Patent No.: US 9,710,002 B2
(45) Date of Patent: Jul. 18, 2017

(54) DYNAMIC BIASING CIRCUITS FOR LOW DROP OUT (LDO) REGULATORS

(71) Applicant: Texas Instruments Incorporated, Dallas, TX (US)

(72) Inventors: Sri Navaneethakrishnan Easwaran, Plano, TX (US); Vijayalakshmi Devarajan, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 14/930,906

(22) Filed: Nov. 3, 2015

(65) Prior Publication Data

US 2016/0349774 A1 Dec. 1, 2016

Related U.S. Application Data

(60) Provisional application No. 62/166,773, filed on May 27, 2015.

(51) Int. Cl.
*G05F 1/56* (2006.01)
*G05F 1/575* (2006.01)
*G05F 1/46* (2006.01)

(52) U.S. Cl.
CPC ..... *G05F 1/56* (2013.01); *G05F 1/575* (2013.01); *G05F 1/465* (2013.01)

(58) Field of Classification Search
CPC H02M 2001/0032; G05F 1/462; G05F 1/465; G05F 1/468; G05F 1/56; G05F 1/565; G05F 1/575
See application file for complete search history.

(56) References Cited

U.S. PATENT DOCUMENTS 7,888,993 B2 2/2011 Easwaran et al.
2006/0055420 A1* 3/2006 Luo ..... G05F 1/565 326/33
2009/0195227 A1* 8/2009 Morino ..... G05F 1/56 323/224
2012/0062197 A1* 3/2012 Luders ..... G05F 1/565 323/282
2013/0113447 A1* 5/2013 Kadanka ..... G05F 1/56 323/280
2013/0265020 A1* 10/2013 Krenzke ..... G05F 1/56 323/273

(Continued)

*Primary Examiner* — Fred E Finch, III
(74) *Attorney, Agent, or Firm* — Lawrence J. Bassuk; Charles A. Brill; Frank D. Cimino

(57) ABSTRACT

Dynamic biasing circuits for low drop out (LDO) regulators are described. In some embodiments, an electronic circuit may include a low drop out (LDO) regulator; and a biasing circuit coupled to the LDO regulator, the biasing circuit configured to: monitor a first electrical current and a second electrical current; select a greater of the first or second electrical currents; and provide the selected electrical current to the LDO regulator. In other embodiments, a method may include: providing a digital core and a low drop out (LDO) regulator coupled to the digital core, wherein the digital core is configured to operate in an active mode and in a standby mode; monitoring, via a current selector circuit coupled to the LDO regulator, a first current and a second current; selecting a greater of the first or second electrical currents; and providing the selected current as a biasing current to the LDO regulator.

14 Claims, 5 Drawing Sheets

(56) References Cited

U.S. PATENT DOCUMENTS

| | | | | |
|---|---|---|---|---|
| 2014/0266103 | A1* | 9/2014 | Wang | G05F 1/462<br>323/274 |
| 2014/0266105 | A1* | 9/2014 | Li | G05F 1/565<br>323/280 |
| 2015/0331434 | A1* | 11/2015 | Lintonen | G05F 1/468<br>323/313 |

* cited by examiner

DYNAMIC BIASING CIRCUITS FOR LOW DROP OUT (LDO) REGULATORS

CROSS-REFERENCE TO RELATED APPLICATIONS

This application claims priority to U.S. Provisional Patent Application Ser. No. 62/166,773 titled "LOW DROP OUT REGULATORS WITH DYNAMIC BIASING CIRCUIT WITH SCALABLE DESIGN COEFFICIENTS" and filed on May 27, 2015, which is incorporated by reference herein.

TECHNICAL FIELD

This specification is directed, in general, to electronic circuits, and, more specifically, to dynamic biasing circuits for low drop out (LDO) regulators.

BACKGROUND

Integrated electronic devices often have multiple cores, such as low voltage (LV) digital cores and high voltage (HV) analog cores. In many cases, each core may be capable of operating in different power modes. For example, during normal operation, a digital core may transition from a low-power mode (e.g., standby mode) to a high-power mode (e.g., active mode), where the current consumption increases.

As the inventors hereof have recognized, a low drop out (LDO) regulator providing the voltage supply to the digital core should have low quiescent current during standby mode, where the load current on the digital core is ultra low (e.g., ~100 nA). However, such an LDO should also be able to provide the required load current (e.g., ~5 mA) with a good transient response during the digital core's active mode.

To address these, and other concerns, systems and methods described herein provide techniques for adapting biasing conditions on an LDO to achieve a low quiescent current during the standby mode, and also to provide good transient response during the active mode.

SUMMARY

Dynamic biasing circuits for low drop out (LDO) regulators are described. In an illustrative, non-limiting embodiment, an electronic circuit may include a low drop out (LDO) regulator; and a biasing circuit coupled to the LDO regulator, the biasing circuit configured to: monitor a first electrical current and a second electrical current; select a greater of the first or second electrical currents; and provide the selected electrical current to the LDO regulator.

The electronic circuit may also include a digital core coupled to the LDO regulator and configured to receive a regulated supply voltage from the LDO regulator. For example, the digital core may be configured to operate in a standby mode and in an active mode such that, when the digital core is in the standby mode, it is configured to operate with the first electrical current, and when the digital core is in the active mode, it is configured to operate with the second electrical current. The first electrical current may be smaller than the second electrical current. The second electrical current may be of the order of 10 μA when the digital core is in the active mode, and approximately 0 A when the digital core is in the standby mode.

The biasing circuit may include a current selector circuit configured to receive the first electrical current and the second electrical current. The current selector circuit may be configured to output the greater of the first or second electrical currents as a bias current to the LDO regulator. The current selector circuit may be further configured to continuously monitor the first and second electrical currents before and after the digital core transitions between the standby mode and active modes.

In some cases, the current selector circuit may further comprise: a first current mirror configured to receive the first current; a second current mirror coupled to the first current mirror at a difference node and configured to receive the second current; a third current mirror coupled to the difference node and configured to receive a difference current between the first current and the second current; and a fourth current mirror configured to receive the second current and coupled to the third current minor at a summing node that adds the second current to the difference current if the first current is greater than the second current.

In another illustrative, non-limiting embodiment, an electronic device, may include a digital core; a low drop out (LDO) regulator coupled to the digital core; and a selector circuit coupled to the LDO regulator, the selector circuit configured to: monitor a first current and a second current; select a greater of the first or second currents; and provide the selected current as a biasing current to the LDO regulator.

In some cases, when the digital core is in a standby mode it is configured to operate with the first current, and when the digital core is in an active mode it is configured to operate with the second current. The first current may be smaller than the second current. The selector circuit may be further configured to continuously monitor the first and second currents before and after the digital core transitions between the standby mode and active modes.

The selector circuit may further include: a first current mirror configured to receive the first current; a second current mirror coupled to the first current mirror at a difference node and configured to receive the second current; a third current mirror coupled to the difference node and configured to receive a difference current between the first current and the second current; and a fourth current mirror configured to receive the second current and coupled to the third current minor at a summing node that adds the second current to the difference current if the first current is greater than the second current.

In yet another illustrative, non-limiting embodiment, a method may include: providing a digital core and a low drop out (LDO) regulator coupled to the digital core, wherein the digital core is configured to operate in an active mode and in a standby mode; monitoring, via a current selector circuit coupled to the LDO regulator, a first current and a second current; selecting a greater of the first or second electrical currents; and providing the selected current as a biasing current to the LDO regulator. In some cases, the monitoring, selecting, and providing operations are performed as the digital core transitions between the standby mode and active modes.

BRIEF DESCRIPTION OF THE DRAWINGS

Figure 1:
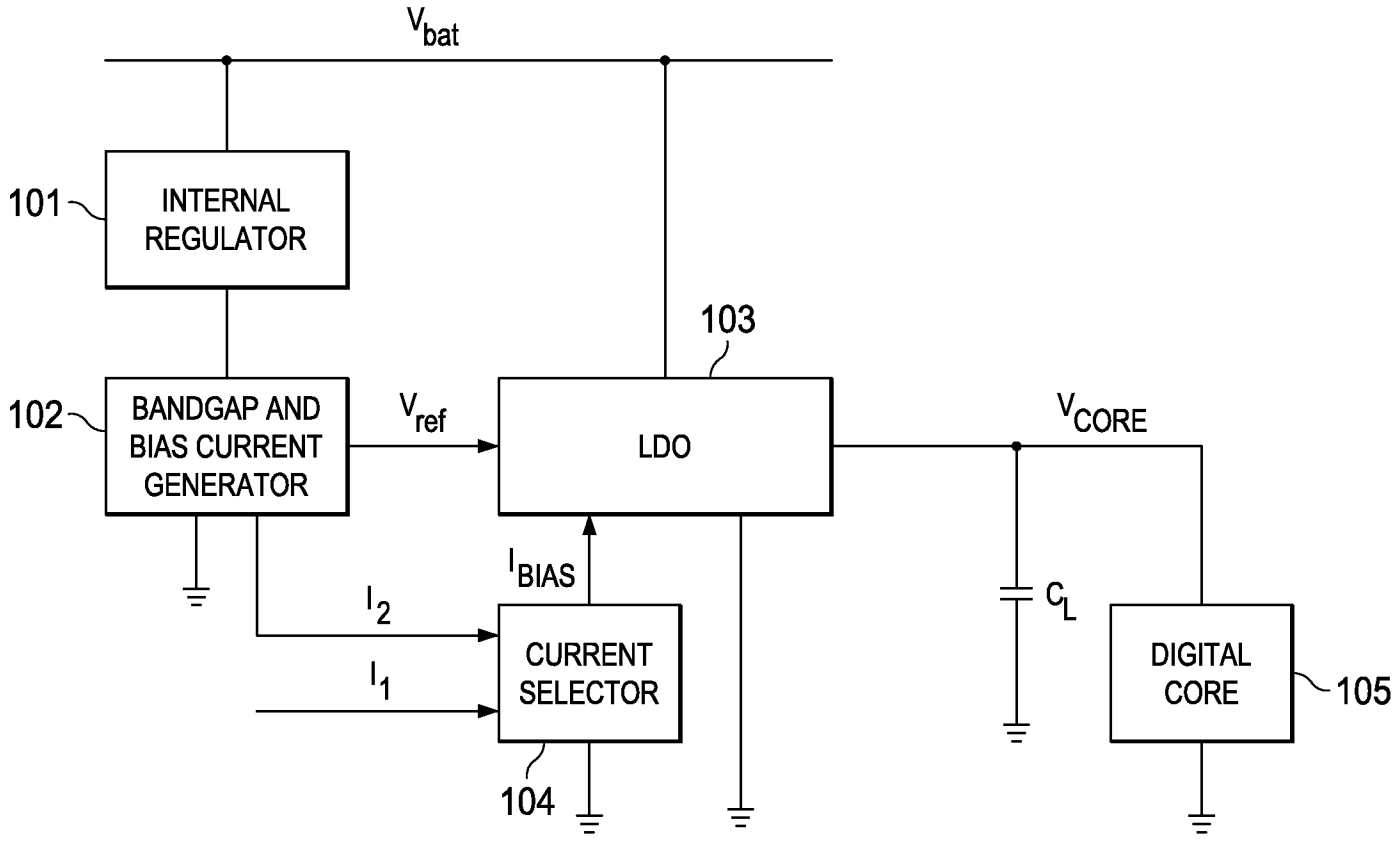

Having thus described the invention(s) in general terms, reference will now be made to the accompanying drawings, wherein:

FIG. 1 is a block diagram of an example of a dynamic biasing circuit for a low drop out (LDO) regulator according to some embodiments.

Figure 2:
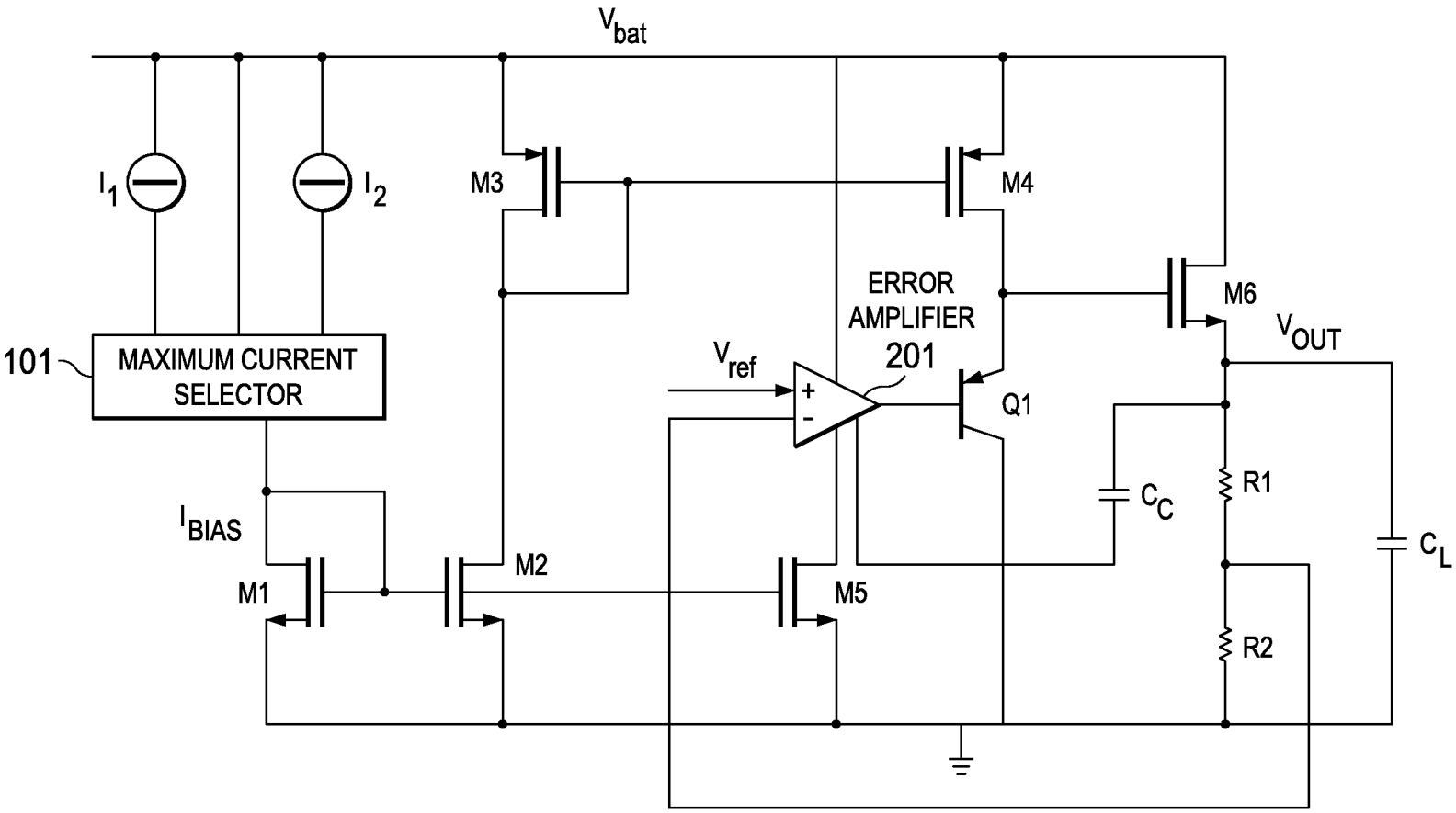

FIG. 2 is a circuit diagram of an example of an LDO regulator architecture according to some embodiments.

Figure 3:
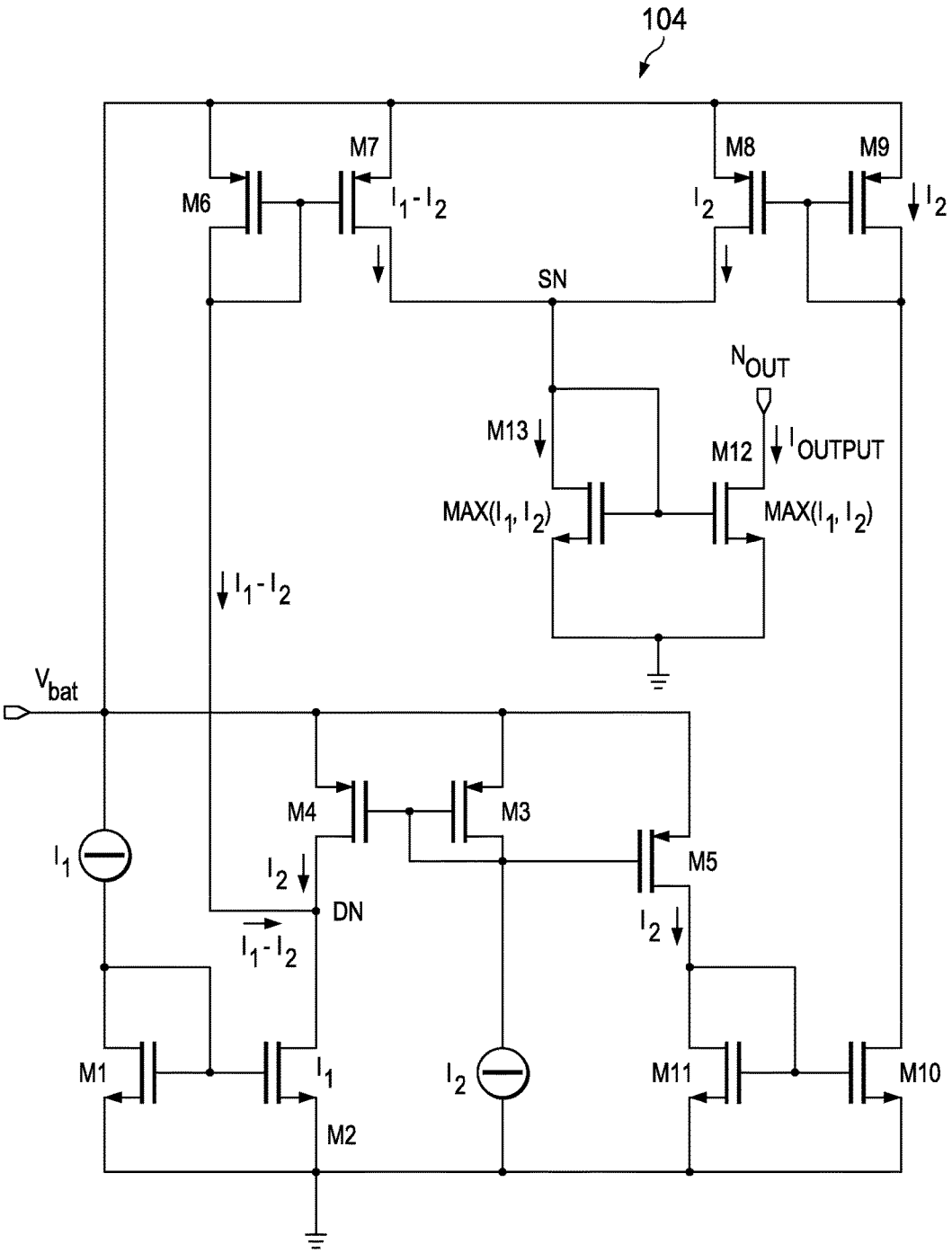

FIG. 3 is a circuit diagram of an example of a current selector circuit according to some embodiments.

Figure 4:
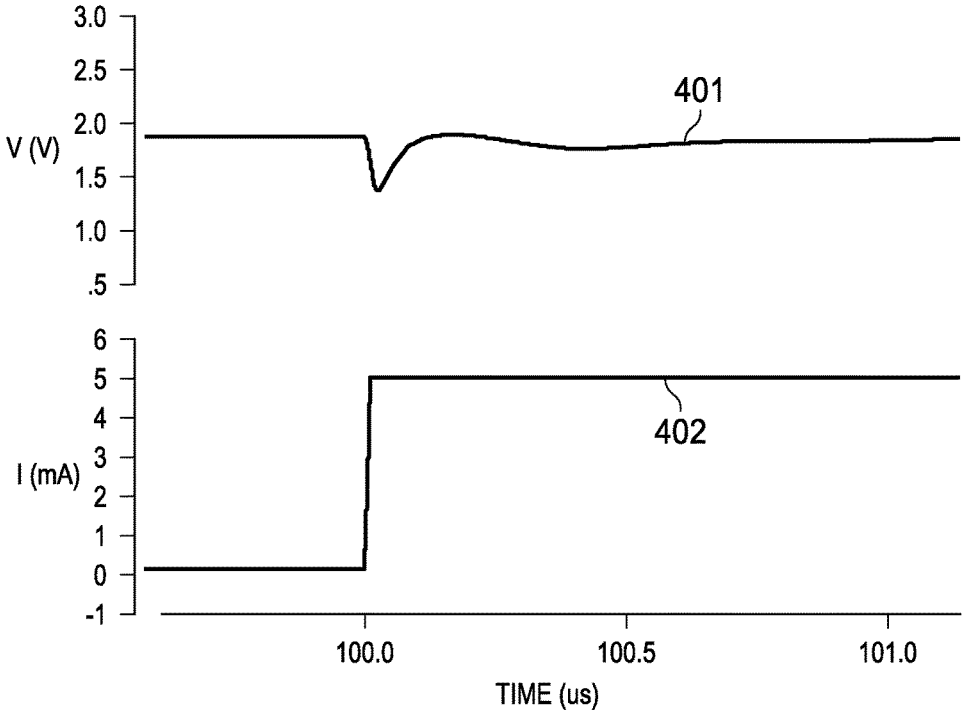
Figure 5:
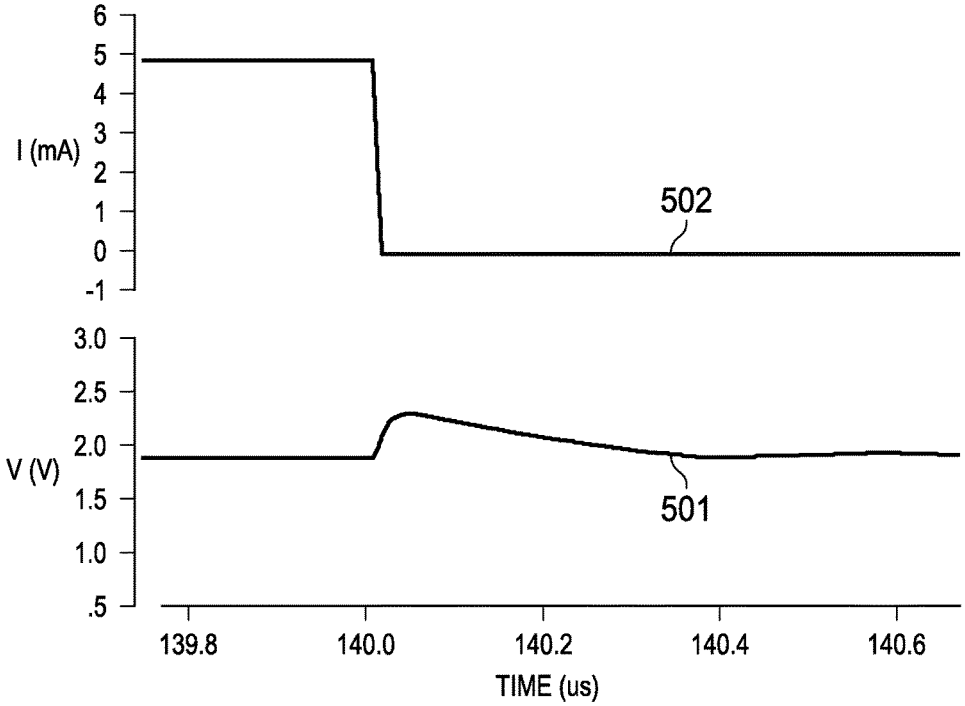

FIGS. 4 and 5 are graphs illustrating the transient response of an LDO regulator according to some embodiments.

Figure 6:
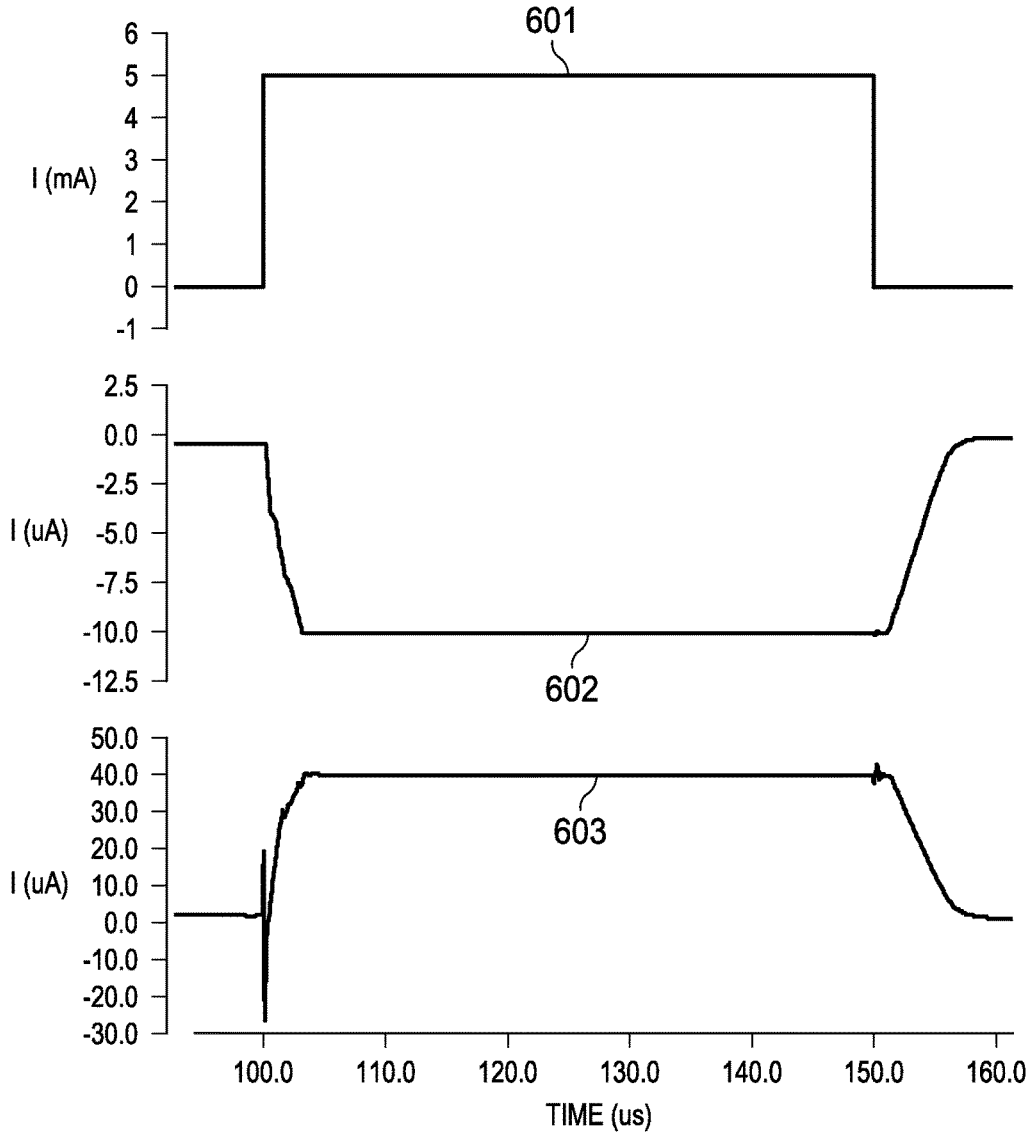

FIG. 6 is a graph illustrating the current consumption of an LDO regulator according to some embodiments.

DETAILED DESCRIPTION

The invention(s) now will be described more fully hereinafter with reference to the accompanying drawings. The invention(s) may, however, be embodied in many different forms and should not be construed as limited to the embodiments set forth herein. Rather, these embodiments are provided so that this disclosure will be thorough and complete, and will fully convey the scope of the invention(s). A person of ordinary skill in the art may be able to use the various embodiments of the invention(s).

In conventional low drop out (LDO) regulators, switching of the bias current is activated by detecting and flagging the change of state in an integrated circuit (IC). A state transition detector is used to flag the change of state in an IC by the digital core. Several modules in the IC are turned on by the digital controller as the state change is detected. This increases the current consumption on the digital core thereby increasing the load current of the LDO. The flag indicating the change of state is also used to change the bias current to the digital core targeting a superior transient response. Such an approach has several disadvantages, such as output oscillations and power-on-resets due to the abrupt change in the bias current, potentially forming a loop and placing the IC in an unexpected state of operation.

In some cases, to protect against noise, the state transition detector output is filtered. However, filtering reduces area efficiency and creates additional delay for the bias current to change.

To address these, and other problems, the techniques discussed may provide LDO regulators with dynamic biasing circuit with scalable design coefficients. As a person of ordinary skill in the art will recognize in light of this disclosure, the designs described below are readily scalable for several load currents—and it are not limited to LDOs for providing supply to digital circuits; but rather these designs are generally applicable to any LDO circuit.

FIG. 1 is a block diagram of an example of a dynamic biasing circuit for a low drop out (LDO) regulator according to some embodiments. As shown, LDO 103 is coupled to voltage supply Vbat, which is also provided to internal regulator 101. Internal regulator 101 is coupled to bandgap and bias current generator 102, which provides reference voltage Vref to LDO 103. Current selector circuit 104 receives a first current, referred to as a standby current $I_1$, as well as a second current, described as active current $I_2$, from bandgap and bias current generator 102. Current selector circuit 104 selects the greater of $I_1$ or $I_2$, and provides the greater one as biasing current $I_{BIAS}$ to LDO 103. The output of LDO 103 provides $V_{CORE}$ to digital core 105 in parallel with capacitance $C_L$.

FIG. 2 is a circuit diagram of an example of an LDO regulator architecture according to some embodiments. As in FIG. 1, here current selector circuit 104 still receives both $I_1$ and $I_2$ and selects the greater of the two currents. The selected current is provided to a node between NMOS transistors $M_1$ and $M_2$, which are in a mirror configuration. PMOS transistors M3 an M4 are also in a mirror configuration, and NMOS transistors M5 and M6 are connected as shown. Error amplifier 201 has is non-inverting input configured to receive Vref, and its inverting input is coupled to voltage divider R1/R2 at the output $V_{OUT}$ of the LDO regulator. Another capacitor Cc is coupled between error amplifier 201 and $V_{OUT}$. Transistor Q1 has its emitter terminal coupled to the drain terminal of PMOS transistor M4, its base terminal coupled to the output of error amplifier 201, and its collector terminal coupled to the source terminal of NMOS transistor M5.

In operation, instead of an abrupt change in biasing $I_{BIAS}$ current when digital core 105 switches from standby to active mode (or vice versa), the circuits of FIGS. 1 and 2 are configured to provide a gradual and high0speed transition of the bias current. This is based on current selector circuit 104, which uses selects the maximum of the bias currents $I_1$ and $I_2$ and provides it to LDO 103. Bias currents $I_1$ and $I_2$ are the inputs to the current selector. The current that is the maximum of the two is $I_{BIAS}$, and is used as the bias source for LDO 103.

Now turning to FIG. 3, a simplified circuit diagram of current selector 104 is shown in accordance with some embodiments. Current selector 104 is generally comprised of several current mirrors (e.g., seven) and current sources $I_1$ and $I_2$. In FIG. 3, current sources $I_1$ and $I_2$ represent the current sources that provide currents also labeled $I_1$ and $I_2$, respectively.

In operation, current selector 104 has the task of providing a bias current at its output node $N_{OUT}$, which corresponds to the larger of $I_1$ or $I_2$. In FIG. 3, current $I_1$ provided by source $I_1$ is mirrored by a current mirror that includes transistors M1 and M2 (e.g., NMOS FETs), and current $I_2$ provided by source $I_2$ is mirrored by two current mirrors that include transistors M3, M4, and M5 (e.g., PMOS FETs).

In this configuration, currents $I_1$ and $I_2$ are mirrored to difference node DN. Particularly, node DN provides the difference between currents $I_1$ and $I_2$, referred to as difference current $(I_1-I_2)$. From node DN, difference current $(I_1-I_2)$ is mirrored by a current mirror that includes transistor M6 and M7 (e.g., preferably PMOS FETs) to the summing node SN.

Furthermore, reference current $I_2$ (which is supplied by the current mirror that includes transistors M3 and M4) is mirrored by two current mirrors that include transistors M8 and M9 (e.g., PMOS FETs) and transistors M10 and M11 (e.g., NMOS FETs). This allows current $I_2$ to be provided to node SN so as to generate a bias current, which is generally the sum of difference current $(I_1-I_2)$ and reference current $I_2$. The bias current is then mirrored by another current mirror that includes transistors M13 and M12 (e.g., NMOS FETs) and provide to output node NOUT.

This bias current is, thus, the sum of the difference current $(I_1-I_2)$ and current $I_2$. If current $I_1$ is greater than current $I_2$, the difference current $(I_1-I_2)$ is positive and it flows through transistor M6 in the direction indicated in FIG. 3, so the positive difference between $I_1$ and $I_2$ is added to the reference current IR to make the bias current be generally equal to $I_2$. If the startup current $I_1$ is less than the reference current $I_2$, difference current $(I_1-I_2)$ would be negative; however, transistor M6 is diode-connected. Thus, a negative difference current $(I_1-I_2)$ cannot flow through transistor M6, meaning that the bias current would generally be equal to $I_2$.

Accordingly, the bias current is generally equal to the larger of currents $I_1$ or $I_2$. Additionally, the target value of current $I_2$ can preferably be designed to be greater than the target value of $I_1$ so that if both currents $I_1$ and $I_2$ settle to their respective target values during a steady-state phase of the circuit 200, then the bias current generally equals current $I_2$. Nevertheless, if $I_2$ suddenly drops and the startup current $I_1$ is present, then the bias current assumes the value of $I_1$.

Additionally or alternatively, the gate of transistor M3 may be directly coupled to the gates of transistor M8 and M5, and transistors M11, M10 and M9 may be omitted. In this alternative configuration, however, noise may couple more easily from transistor M3 to transistor M8; that is, current mirrors M5, M11, M10, M9 provide additional noise suppression.

In summary, $I_1$ and $I_2$ are fed into the current mirror stages. The output of the current selector is $I_{output}$, which is the maximum value between $I_1$ and $I_2$, which is provided to LDO 103 as $I_{BIAS}$. In some implementations, during the standby mode of digital core 105, $I_2$ is approximately 0 A and during the active mode $I_2$ is of the order of 10 uA. Current selector circuit 104 contains several current mirrors (diode connected transistors) that are low impedance thereby avoiding delays in the change of the LDO bias current. This provides superior transient response to the LDO when the state changes from standby mode to the active mode and vice versa.

To further illustrate the foregoing, FIGS. 4 and 5 are graphs of the transient response of LDO regulator 103 in a simulated implementation. Particularly, curve 401 of FIG. 4 shows the voltage at $V_{OUT}$ (or $N_{OUT}$) as the biasing current for digital core 105 transitions from 100 nA (standby mode) to 5 mA (active mode). In this case, the settling time of $V_{OUT}$ is less than 100 ns. Conversely, curve 501 of FIG. 5 shows the voltage at $V_{OUT}$ in the reverse direction; that is, as the biasing current for digital core 105 transitions from 5 mA (active mode) to 100 nA (standby mode). Here, the settling time of $V_{OUT}$ is less than 200 ns.

FIG. 6 is a graph of the current consumption of an LDO regulator 103 in a simulated implementation. Particularly, curve 601 shows the load current change on the LDO from 100 nA (standby) to 5 mA (active) then back to 100 nA (standby). As illustrated, curve 602 shows a gradual change in the current selector output $I_{BIAS}$ from 100 nA to 10 μA, and curve 603 shows the LDO quiescent current consumption change from 100 nA (standby mode) to 40 μA active mode current transitioning to a 100 nA standby mode current.

The active mode load current can change across applications. For example, some applications may need 5 mA and some may be higher to 10 mA. The load current is thereby scalable. If we also adapt scale $I_2$ along with the W/L of the power transistor Q1, the overall design is scalable without having any impact to the stability or to the gain. This circuit also down very well, and thereby the stability of the design is unchanged—i.e., the poles and Unity Gain bandwidth are unaltered.

As discussed herein, a dynamic biasing scheme for an LDO is provided with design scalable feature. The LDO provides gradual change of bias current leading low current consumption in standby mode and superior transient response in active mode. The current selector used in the design provides robustness against noise spikes during state transition that can lead to any unexpected state of operation of an IC. Moreover, filtering requirements are reduced or removed, thereby leading to an area efficient design.

It should be understood that the various operations described herein may be implemented by processing circuitry or other hardware components. The order in which each operation of a given method is performed may be changed, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

A person of ordinary skill in the art will appreciate that the various circuits depicted above are merely illustrative and is not intended to limit the scope of the disclosure described herein. In particular, a device or system configured to perform audio power limiting based on thermal modeling may include any combination of electronic components that can perform the indicated operations. In addition, the operations performed by the illustrated components may, in some embodiments, be performed by fewer components or distributed across additional components. Similarly, in other embodiments, the operations of some of the illustrated components may not be provided and/or other additional operations may be available. Accordingly, systems and methods described herein may be implemented or executed with other circuit configurations.

It will be understood that various operations discussed herein may be executed simultaneously and/or sequentially. It will be further understood that each operation may be performed in any order and may be performed once or repetitiously.

Many modifications and other embodiments of the invention(s) will come to mind to one skilled in the art to which the invention(s) pertain having the benefit of the teachings presented in the foregoing descriptions, and the associated drawings. Therefore, it is to be understood that the invention(s) are not to be limited to the specific embodiments disclosed. Although specific terms are employed herein, they are used in a generic and descriptive sense only and not for purposes of limitation.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A low drop out regulator system comprising:

(a) maximum current selector circuitry having a first input for a first current, a second input for a second current, and a bias current output for a bias current selected from the larger of the first current and the second current;

(b) a low drop out regulator including:

(i) a bias current input coupled to the bias current output;

(ii) a voltage output;

(iii) a series connection of two resistors coupled between the voltage output and a circuit ground;

(iv) an output drive transistor having a connection to a supply voltage, a connection to the voltage output, and a control input;

(v) an error amplifier having a non-inverting input coupled to a reference voltage, an inverting input coupled to between the two resistors, and an output coupled to the control input;

(vi) a first pair of transistors coupled in a current mirror having a first connection coupled to the bias current input, control inputs coupled to the bias current input, ground connections to the circuit ground, and a second connection coupled to the control input; and (vii) a third transistor coupled between the error amplifier and circuit ground and having a control input coupled to the bias current input.

2. The system of claim 1 including a second pair of transistors coupled in a current mirror having supply connections with the supply voltage, a first connection and control inputs coupled to the second connection of the first pair of transistors, and a second connection, and the second connection being coupled to the voltage output.

3. The system of claim 1 including a fourth transistor having an emitter terminal, a base terminal coupled to the output of the error amplifier, and a collector terminal coupled to circuit ground, and current mirror circuitry coupled between the emitter terminal and the voltage source.

4. The system of claim 1 including a fourth transistor having an emitter terminal, a base terminal coupled to the output of the error amplifier, and a collector terminal coupled to circuit ground, and current mirror circuitry coupled between the emitter terminal and the voltage source and being coupled with the bias current input.

5. The system of claim 1 including a capacitor coupled between the voltage output and the circuit ground and a digital core connected to the voltage output.

6. The system of claim 1 including a bandgap and active current generator connected to the reference voltage and to one of the first current and the second current.

7. The system of claim 1 in which the first current is a standby current and the second current is an active current.

8. A low drop out regulator system comprising:

(a) maximum current selector circuitry having a first input for a first current, a second input for a second current, and a bias current output for a bias current selected from one of the first current and the second current;

(b) a low drop out regulator including:

(i) a bias current input coupled to the bias current output;

(ii) a voltage output; and (iii) an output drive transistor having a connection to a supply voltage, a connection to the voltage output, and a control input coupled to the bias current input.

9. The system of claim 8 including an error amplifier having an input coupled to the voltage output, an input coupled to a reference voltage, and an output coupled to the control input, and a bias transistor coupled between the error amplifier and a circuit ground and having a control input coupled to the bias current input.

10. The system of claim 8 including an error amplifier having an input coupled to the voltage output, an input coupled to a reference voltage, and an output coupled to the control input, and transistor circuitry having an input coupled to the bias current input and including a transistor coupling the output of the error amplifier to the control input of the output drive transistor.

11. The system of claim 8 including an error amplifier having an input coupled to the voltage output, an input coupled to a reference voltage, and an output coupled to the control input, a bias transistor coupled between the error amplifier and a circuit ground and having a control input coupled to the bias current input, and transistor circuitry having an input coupled to the bias current input and including a transistor coupling the output of the error amplifier to the control input of the output drive transistor.

12. The system of claim 8 including a capacitor coupled between the voltage output and the circuit ground and a digital core connected to the voltage output.

13. The system of claim 8 including a bandgap and active current generator connected to the reference voltage and to one of the first current and the second current.

14. The system of claim 8 in which the first current is a standby current and the second current is an active current.

* * * * *